US006343587B1

(12) United States Patent
Kreutziger

(10) Patent No.: US 6,343,587 B1
(45) Date of Patent: Feb. 5, 2002

(54) FUEL INJECTOR ARMATURE PERMITTING FLUID AND VAPOR FLOW

(75) Inventor: Ann Marie Kreutziger, Yorktown, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/605,653

(22) Filed: Jun. 28, 2000

(51) Int. Cl.[7] ..... F02M 51/00
(52) U.S. Cl. ..... 123/472; 123/516
(58) Field of Search ..... 123/516, 472, 123/445, 473; 239/585.4; 251/129.08

(56) References Cited

U.S. PATENT DOCUMENTS 3,481,542 A * 12/1969 Huber ..... 123/472
4,022,166 A * 5/1977 Bart ..... 123/472
5,197,674 A * 3/1993 Ketterer et al. ..... 239/408
5,271,563 A * 12/1993 Cerny et al. ..... 239/463
6,247,453 B1 * 6/2001 Potschin et al. ..... 123/472

* cited by examiner

*Primary Examiner*—Bibhu Mohanty

(57) ABSTRACT

A fuel injector including a tube assembly having a longitudinal axis extending between a first end and a second end, a seat secured at the second end of the tube assembly and defining an opening. An armature assembly is movable along the longitudinal axis between first and second positions with respect to the seat. The armature includes a first set of passages permitting fluid flow therethrough and a second set of passages permitting vapor flow therethrough. Additionally, a method of dissipating fuel vapors in a fuel injector includes providing the armature with a first set of passages permitting fluid flow therethrough and a second set of passages permitting vapor flow therethrough.

8 Claims, 3 Drawing Sheets

FUEL INJECTOR ARMATURE PERMITTING FLUID AND VAPOR FLOW

BACKGROUND OF THE INVENTION

The present invention relates to an armature, and more particularly to a fuel injector armature permitting separate fluid and vapor flow.

In the conventional art, it is known to use a fuel injector in an engine compartment of an automobile, for example. It is also known in the conventional art to use an armature in the fuel injector. Fuel flows from an inlet of the fuel injector, through an opening in the armature, to the outlet of the fuel injector. High engine operating temperatures, engine covers, and crowded engine compartments prevent air flow from cooling the fuel injector, which causes fuel disposed within the fuel injector to change from a liquid to a gaseous state (i.e., vaporize). Vaporization is more likely to occur when the engine has been heated (e.g., operated) and is then turned off, since the fuel injector and fuel remain hot, but cool liquid fuel is not being introduced into the system. Vaporized fuel can block the opening in the armature. When the vaporized fuel blocks the opening in the armature, liquid fuel is prevented from flowing through the fuel injector, and reliable engine restarts can be adversely affected. Thus, the engine must cool, thereby allowing the vaporized fuel to condense into a liquid, before the engine can be reliably restarted.

In the conventional art, it is known to cool the engine using a fan. However, this solution requires additional hardware (e.g., fan components), additional room in the engine compartment (e.g., permit adequate air flow paths, install fan components, etc.), and additional manufacturing and maintenance costs. Thus, it is desirable to have an improved fuel injector that dissipates the effects of vapor fuel flow when the engine has been heated and turned off, thereby allowing the engine to be reliably restarted.

SUMMARY OF THE INVENTION

The present invention provides a fuel injector. The fuel injector comprises a tube assembly having a longitudinal axis extending between a first end and a second end; a seat secured at the second end of the tube assembly, the seat defining an opening; and an armature assembly movable along the longitudinal axis between first and second positions with respect to the seat. The armature assembly is spaced from the seat such that fuel flow through the opening is permitted in the first position and the armature assembly contiguously engages the seat such that fuel flow through the opening is prevented in the second position. The armature includes a first set of passages permitting a first fluid flow in a first direction generally along the longitudinal axis; and a second set of passages permitting a second fluid flow in a second direction generally along the longitudinal axis, the second direction being generally opposite to the first direction.

The present invention also provides an armature assembly for a fuel injector. The armature moves along a longitudinal axis between first and second positions with respect to a seat having an opening. The armature assembly is spaced from the seat such that fuel flow through the opening is permitted in the first position and the armature assembly contiguously engages the seat such that fuel flow through the opening is prevented in the second position. The armature comprises a first set of passages permitting a first fluid flow in a first direction generally along the longitudinal axis; and a second set of passages permitting a second fluid flow in a second direction generally along the longitudinal axis, the second direction being generally opposite to the first direction.

The present invention also provides a method of dissipating fuel vapor in a fuel injector. The fuel injector has a tube assembly extending along a longitudinal axis between a first end and a second end. A seat is secured at the second end of the tube assembly and defines an opening. And an armature assembly that is movable along the longitudinal axis between first and second positions with respect to the seat. The armature assembly is spaced from the seat such that fuel flow through the opening is permitted in the first position and the armature assembly contiguously engages the seat such that fuel flow through the opening is prevented in the second position. The method comprises providing the armature with a first set of passages permitting liquid fuel flow in a first direction generally from the first end toward the second end; and providing the armature with a second set of passages permitting vapor fuel flow in a second direction generally from the second end toward the first end.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain features of the invention.

DETAILED DESCRIPTION OF THE PREFERRED EMBODIMENTS

Figure 1:
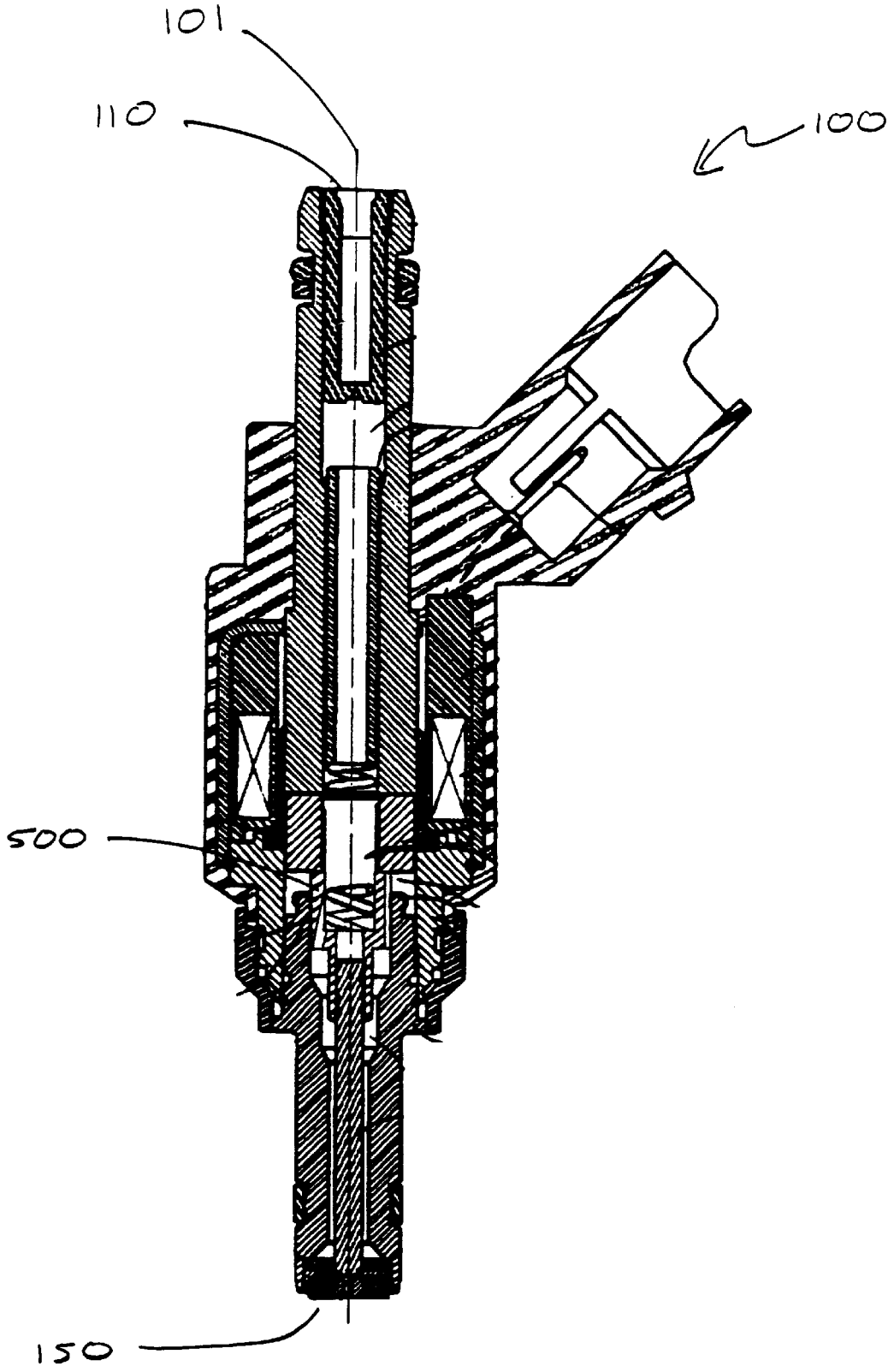
FIG. 1 is a cross-sectional view of a fuel injector including an armature assembly according to the present invention.

Referring to the drawings, FIG. 1 shows a fuel injector 100 including an armature assembly 500. The fuel injector 100 can be any conventional fuel injector, including top or bottom feeder fuel injectors or the like.

The fuel injector 100 includes a tube assembly having a fuel inlet end portion 110, a fuel outlet end portion 150, and the armature assembly 500. As it is used in connection with the present invention, the term "assembly" can refer to a single homogenous material formation, a construction of multiple components that are generally fixed together, a group of operationally interrelated features, or a combination thereof. The fuel inlet end portion 110 of the fuel injector 100 is adapted to be operatively connected to a fuel rail (not shown). The fuel outlet end portion 150 of the fuel injector 100 is adapted to be operatively associated with a combustion chamber of an internal combustion engine (not shown). The fuel inlet and outlet end portions 110,150 define a fuel injector longitudinal axis 101. The armature assembly 500 includes an armature assembly axis 501. The armature assembly 500 is disposed between and in fluid communication with both the fuel inlet end portion 110 and the fuel outlet end portion 150 of the fuel injector 100, such that the armature assembly axis 501 generally coaxial with the fuel injector longitudinal axis 101.

During operation of the engine, fuel flows from the fuel rail (not shown) into the fuel inlet end portion 110 of the fuel injector 100. Fuel flow continues from the fuel inlet end portion 110 of the fuel injector 100, through the armature assembly 500 (to be discussed in detail later), to the fuel outlet end portion 150 of the fuel injector 100. The fuel then flows from the fuel outlet end portion 150 of the fuel injector 100 to the combustion chamber of the engine (not shown).

Figure 2:
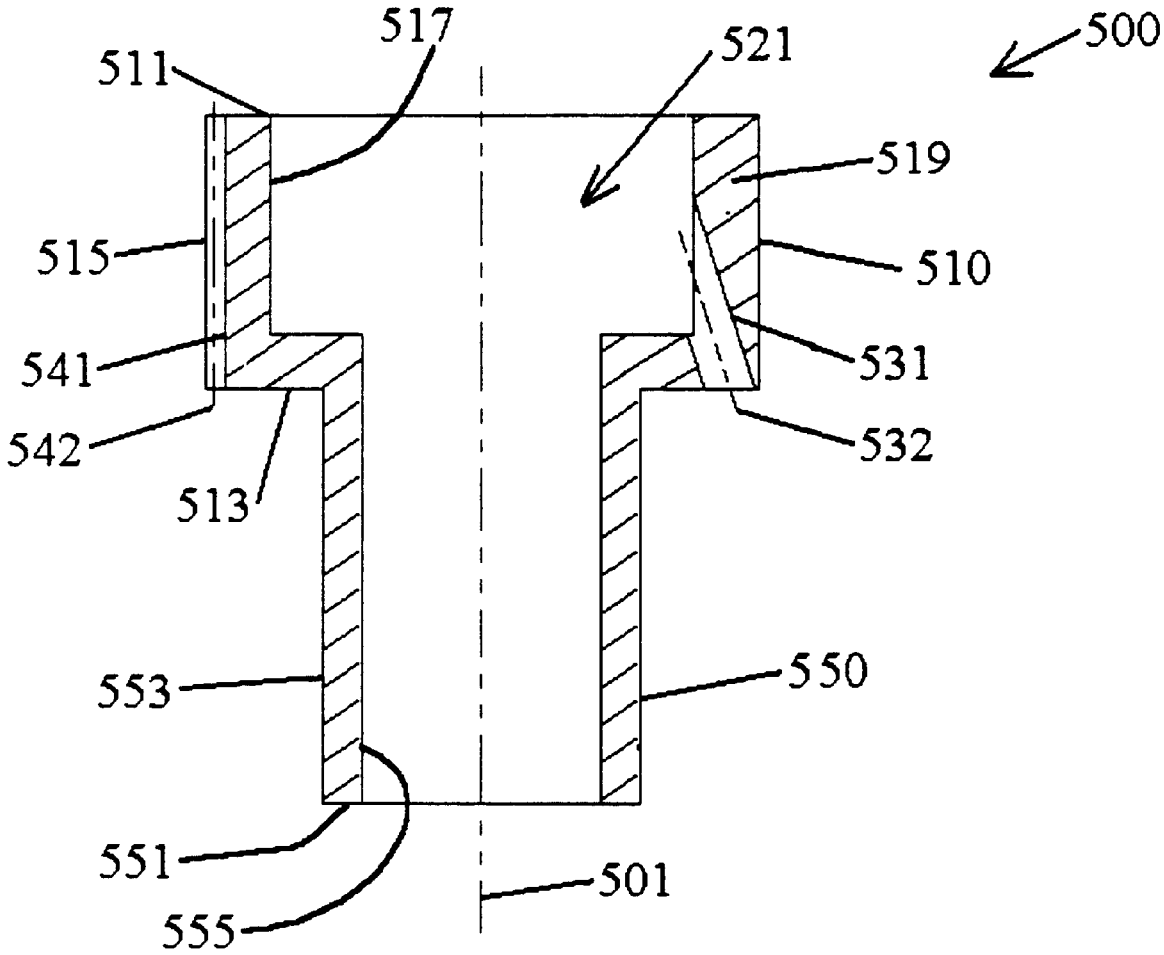
FIG. 2 is a cross-sectional view of the armature assembly according to the present invention.
Figure 3:
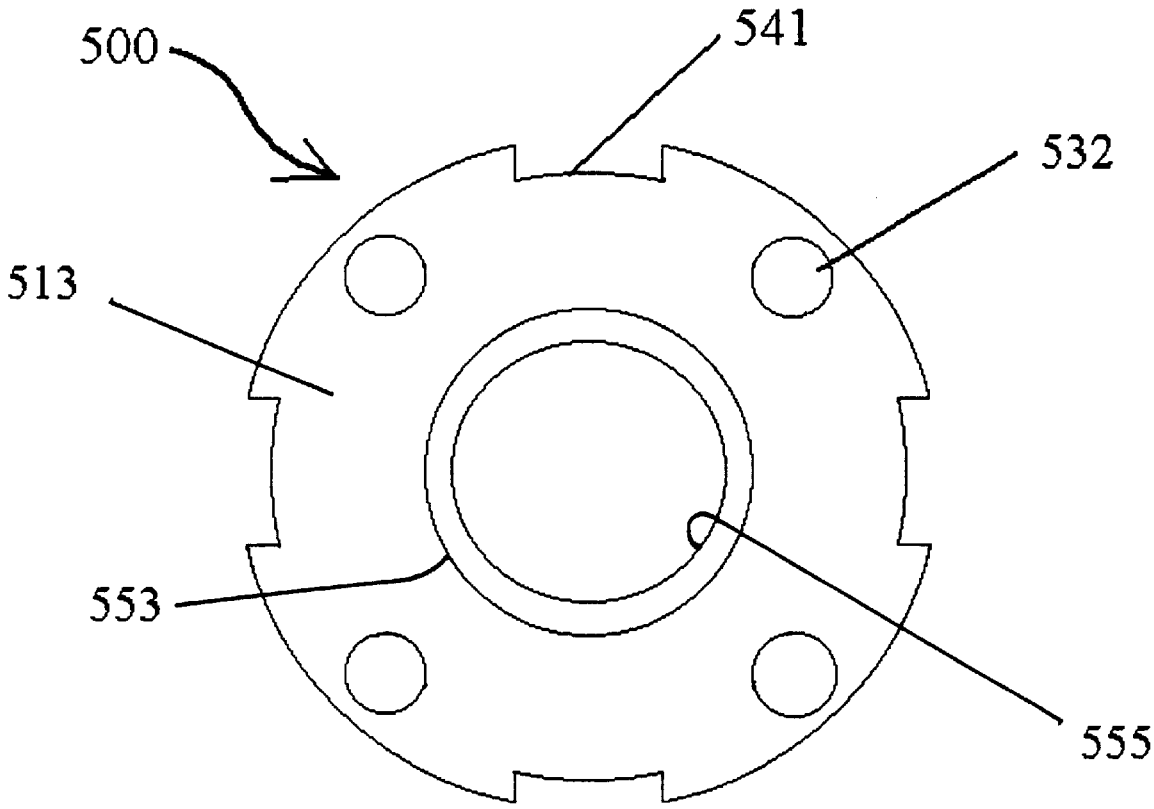
FIG. 3 is a bottom view of the armature assembly according to the present invention.

The armature assembly 500 will now be discussed in detail. As shown in FIGS. 2 and 3, the armature assembly 500 includes a first portion 510 and a second portion 550. The first portion 510 of the armature assembly 500 can be disposed proximate the fuel inlet portion end 110 of the fuel injector 100. The second portion 550 of the armature assembly 500 can be disposed proximate the fuel outlet end portion 150 of the fuel injector 100.

The first portion 510 includes a first surface 511 and a second surface 513. The first and second surfaces 511,513 can be approximately flat, and can be generally parallel to each other.

An exterior surface 515 and an interior surface 517 are disposed between the first and second surfaces 511,513. The exterior surface 515 defines a maximum radial dimension of the armature assembly 500. The interior surface 517 defines a first portion of a first passage 521. The first portion of the first passage 521 is adapted to permit fuel flow through the first portion 510 of the armature assembly 500. The cross-sectional shapes of the exterior surface and interior surfaces 515,517 can be a variety of shapes. For example, each cross-section of the exterior surface 515 and the interior surface 517 can be substantially circular and coaxial with the armature assembly axis 501 such that the exterior and interior surfaces 515,517 define an annular wall 519.

The annular wall 519 includes a second passage 531. The second passage 531 is adapted to permit liquid fuel flow therethrough. The second passage 531 is in fluid communication with the first passage 521 of the armature 500 and the fuel outlet end portion 150 of the fuel injector 100. By this arrangement, the second passage 531 can permit liquid fuel flow from the fuel inlet portion 110 to the fuel outlet portion 150 of the fuel injector 100.

The second passage 531 extends along a second passage axis 532. The second passage axis 532 can be disposed at an angle relative to the armature assembly axis 501 of the armature 500. Preferably, the second passage axis 532 of the second passage 531 is disposed at an angle of about 10 degrees to the armature assembly axis 501 of the armature 500. A cross-section of the second passage 531 can be a variety of shapes, e.g., substantially circular. A diameter of the second passage 531 can be greater than a fuel bore in a conventional armature. According to one example of the invention, the second passage 531 has a diameter of approximately 1.25 inches.

A set of second passages 531 can extend through the annular wall 519 of the armature assembly 500. As it is used in connection with the present invention, the term "set" can refer to one or more examples of a feature. For example, four second passages 531 can be disposed in the armature assembly 500. The four second passages 531 can be about equally spaced around the armature assembly axis 501.

The first portion 510 of the armature 500 further includes a third passage 541. The third passage 541 is adapted to permit vapor fuel flow therethrough. The third passage 541 is in fluid communication with the outlet end portion 150 and the inlet end portion 110 of the fuel injector 100. By this arrangement, the third passage 541 is adapted to permit gaseous fuel to flow from generally the fuel outlet end portion 150 toward the fuel inlet end portion 110 of the fuel injector 100. Thus, the third passage 541 offers an alternate path for fuel vapor to be displaced, thereby allowing liquid fuel to flow through the first and second passages 521,532.

The third passage 541 can extend along a third passage axis 542. The third passage axis can be generally parallel to the armature assembly axis 501 of the armature 500. A cross-section of the third passage 541 can be a variety of shapes. For example, the cross-section of the third passage 541 can be a generally rectangular channel with radiuses corners.

A set of third passage 541 can be disposed in the armature assembly 500. For example, four third passages 541 can be disposed in the armature assembly 500. The four third passage 541 can be about equally spaced around the armature assembly axis 501. Moreover, the set of third passages 541 can be angularly offset around the armature assembly axis 501 with respect to the set of second passages 531

The second portion 550 of the armature assembly 500 includes the second surface 513 and a third surface 551. The second and third surfaces 513,551 can be generally flat, and can be generally parallel to each other. Moreover, the first, second, and third surfaces 511,513,551 can be generally parallel to one another.

An exterior surface 553 and an interior surface 555 are disposed between the second and third surfaces 513,551. The exterior surface 553 defines a maximum radial dimension of the second portion 550, which can be constricted with respect to the maximum radial dimension of the first portion 510, as defined by the exterior surface 515. The interior surface 555 defines a second portion of the first passage 521. The second portion of the first passage 521 is also adapted to permit liquid fuel flow through the second portion 550 of the armature 500. Each cross-section of the exterior surface 553 and an interior surface 555 can be of a variety of shapes. Each cross-section of the exterior surface 553 and the interior surface 555 can be substantially circular and coaxial with the armature assembly axis 501.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What I claim is:

1. A fuel injector, comprising:

a tube assembly having a longitudinal axis extending between a first end and a second end;

a seat secured at the second end of the tube assembly, the seat defining an opening; and an armature assembly movable along the longitudinal axis between first and second positions with respect to the seat, the armature assembly is spaced from the seat such that fuel flow through the opening is permitted in the first position and the armature assembly contiguously engages the seat such that fuel flow through the opening is prevented in the second position, the armature including;

a first set of passages permitting a first fluid flow in a first direction generally along the longitudinal axis; and a second set of passages permitting a second fluid flow in a second direction generally along the longitudinal axis, the second direction being generally opposite to the first direction.

2. The fuel injector according to claim 1, wherein the first set of passages permits liquid flow therethrough, and the second set of passages permits vapor flow therethrough.

3. The fuel injector according to claim 1, further comprising:

a first portion including an annular wall having an exterior surface confronting the tube assembly and an interior surface, the first set of passages extending through the annular wall and connecting the interior and exterior surfaces.

4. The fuel injector according to claim 3, wherein the second set of passages are cooperatively defined by the exterior surface and the tube assembly.

5. The fuel injector according to claim 3, wherein the armature further includes:

a second portion connected with first portion, the second portion being relatively constricted with respect to the first portion; and a third set of passages extending through the first and second portions, the third set of passages permitting a third fluid flow generally in the first direction and being in fluid communication with the first set of passages.

6. The fuel injector according to claim 3, wherein each of the first set of passages extend along a respective axis that is obliquely oriented with respect to the longitudinal axis.

7. A method of dissipating fuel vapor in a fuel injector, the fuel injector having a tube assembly extending along a longitudinal axis between a first end and a second end, a seat secured at the second end of the tube assembly and defining an opening, and an armature assembly movable along the longitudinal axis between first and second positions with respect to the seat, the armature assembly is spaced from the seat such that fuel flow through the opening is permitted in the first position and the armature assembly contiguously engages the seat such that fuel flow through the opening is prevented in the second position, the method comprising:

providing the armature with a first set of passages permitting liquid fuel flow in a first direction generally from the first end toward the second end; and providing the armature with a second set of passages permitting vapor fuel flow in a second direction generally from the second end toward the first end.

8. The method according to claim 7, wherein the providing the first set of passages includes orienting each of the first set of passages to extend obliquely with respect to the longitudinal axis and to extend through the armature, and wherein the providing the second set of passages includes providing at least one channel on a surface of the armature confronting the tube assembly and orienting the at least one channel substantially parallel to the longitudinal axis.

* * * * *